US006632122B2

(12) United States Patent
Klitsner et al.

(10) Patent No.: US 6,632,122 B2
(45) Date of Patent: Oct. 14, 2003

(54) TOY VEHICLE PROGRAMMED TO FOLLOW A MANUALLY DRAWN PATH

(75) Inventors: Daniel B. Klitsner, Larkspur, CA (US); Brian P. Clemens, San Francisco, CA (US); Philip H. Neal, San Rafael, CA (US); Stephen N. Weiss, Philadelphia, PA (US); Yeung Chung Wong, Tuen Mun (HK); Jesse Dorogusker, San Francisco, CA (US); Charles S. McCall, San Francisco, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/071,523

(22) Filed: Feb. 8, 2002

(65) Prior Publication Data

US 2002/0111118 A1 Aug. 15, 2002

Related U.S. Application Data

(60) Provisional application No. 60/290,382, filed on May 11, 2001, and provisional application No. 60/267,683, filed on Feb. 9, 2001.

(51) Int. Cl.[7] ..... A63H 29/22

(52) U.S. Cl. ..... 446/484; 446/457; 446/465; 446/441

(58) Field of Search ..... 446/484, 269, 446/275, 431, 441, 451, 457, 465, 468, 491

(56) References Cited

U.S. PATENT DOCUMENTS

| | | | | |
|---|---|---|---|---|
| 4,556,397 A | | 12/1985 | Arad et al. | |
| 4,813,907 A | | 3/1989 | Rissman et al. | |
| 5,501,601 A | | 3/1996 | Todokoro et al. | |
| 5,656,907 A | | 8/1997 | Chainani et al. | |
| 5,681,220 A | | 10/1997 | Bertram et al. | |
| 5,697,829 A | | 12/1997 | Chainani et al. | |
| 5,724,074 A | | 3/1998 | Chainani et al. | |
| 5,908,345 A | | 6/1999 | Choi | |
| 6,078,864 A | * | 6/2000 | Long et al. | 701/209 |
| 6,083,104 A | | 7/2000 | Choi | |
| 6,421,600 B1 | * | 7/2002 | Ross | 701/117 |

FOREIGN PATENT DOCUMENTS

EP 1 230 964 A2 * 8/2002

* cited by examiner

*Primary Examiner*—Derris N. Banks
*Assistant Examiner*—Ali Abdelwahed
(74) *Attorney, Agent, or Firm*—Akin Gump Strauss Hauer & Feld, L.L.P.

(57) ABSTRACT

A toy vehicle is configured for itinerant maneuvers and is programmed by manually drawing a path on an exposed surface of a mechanical touch screen assembly on the vehicle. A microprocessor, coupled with the touch screen assembly, reads the manually drawn path and controls movement of the vehicle to follow the manually drawn path. In one embodiment, the drawn path is erased to enter a new path by pivoting the first sheet of the assembly away from the second sheet and, in another embodiment, by separating the first and second sheets by sliding a horizontal plate between the sheets. A sensor on the vehicle detects the presence of a stylus in a holder. The microprocessor responds to the presence to initiate the itinerant movement and/or activate a visual indicator or an audio generator or both in the toy vehicle.

25 Claims, 18 Drawing Sheets

TOY VEHICLE PROGRAMMED TO FOLLOW A MANUALLY DRAWN PATH

CROSS-REFERENCE TO RELATED APPLICATIONS

This application claims the benefit of U.S. Provisional Application No. 60/290,382, filed May 11, 2001, entitled "Map 'N Go Manually Programmable Toy Vehicles" and U.S. Provisional Application No. 60/267,683, filed Feb. 9, 2001, also entitled "Map 'N Go Manually Programmable Toy Vehicles"

BACKGROUND OF THE INVENTION

This invention relates to toy vehicles and, in particular, to toy vehicles which can be manually programmed by the user.

BRIEF SUMMARY OF THE INVENTION

Briefly stated, the present invention is directed to a programmable toy vehicle configured for itinerant maneuvers. The vehicle includes a motive chassis with at least one maneuver motor. A microprocessor on the motive chassis is operably coupled with the motor and configured to control itinerant maneuvers of the vehicle at least in part through the motor. A mechanical touch screen assembly on the motive chassis is operably coupled with the microprocessor and configured to input to the microprocessor a path of itinerant movement of the vehicle manually drawn on an exposed surface of the touch screen assembly. The microprocessor reads the manually drawn path and controls movement of the motive chassis to follow the manually drawn path.

The present invention is also directed to a method of programming a toy vehicle including a motive chassis with at least one maneuver motor, a microprocessor on the motive chassis operably coupled with the motor and configured to control itinerant maneuvers of the vehicle at least in part through the motor, and a mechanical touch screen assembly on the motive chassis operably coupled with the microprocessor. The method includes the step of manually applying pressure to an exposed surface of the touch screen assembly while moving along the exposed surface so as to manually draw on the exposed surface a path of itinerant movement of the vehicle. The method further includes the step of activating the microprocessor to read the manually drawn path and control movement of the motive chassis to follow the manually drawn path.

BRIEF DESCRIPTION OF THE SEVERAL VIEWS OF THE DRAWINGS

The following detailed description of preferred embodiments of the present invention, will be better understood when read in conjunction with the appended drawings. For the purpose of illustrating the invention, there is shown in the drawings embodiments which are presently preferred. It should be understood, however, that the present invention is not limited to the precise arrangements and instrumentalities shown.

In the drawings:

Figure 1:
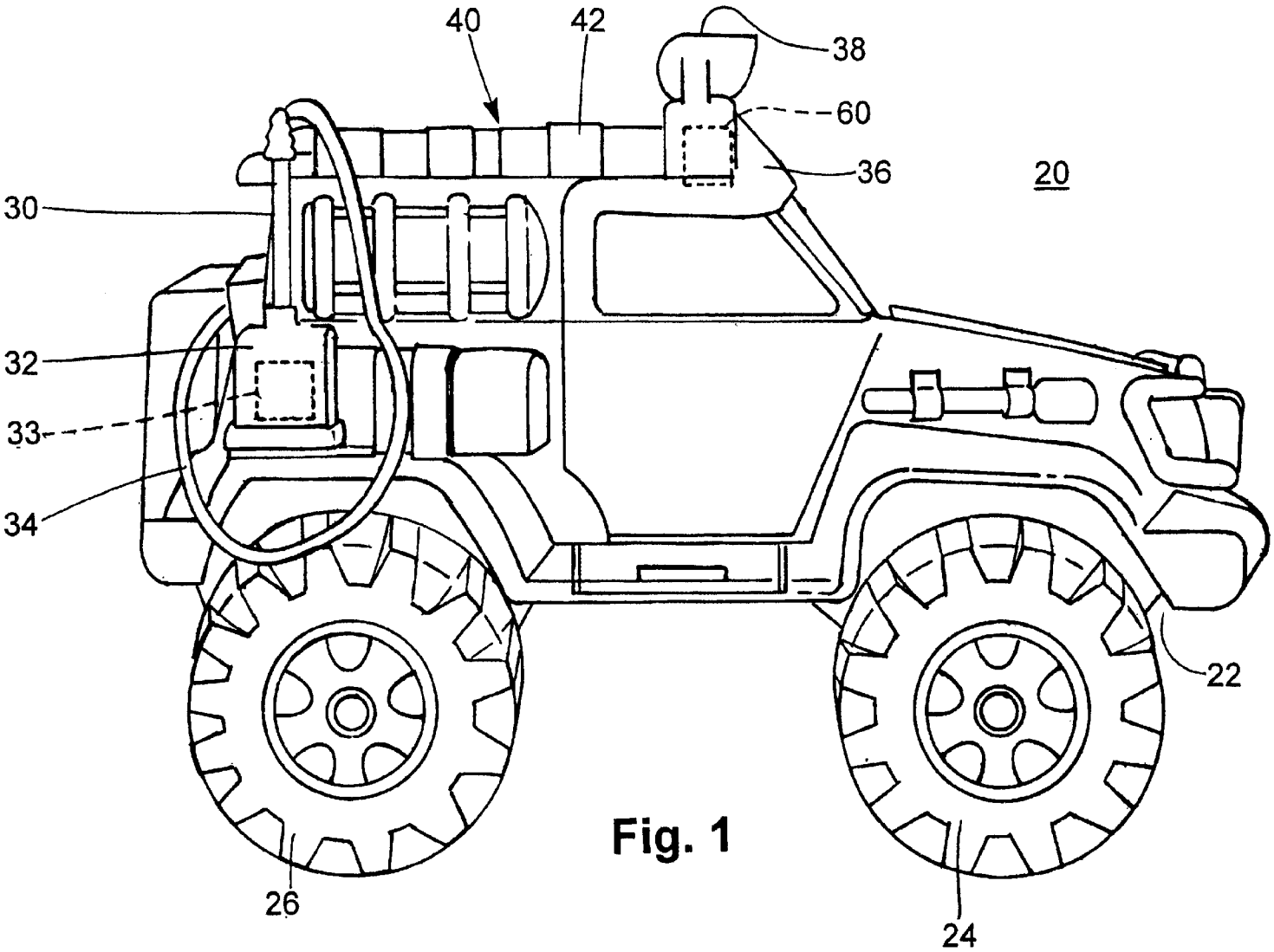
Figure 2:
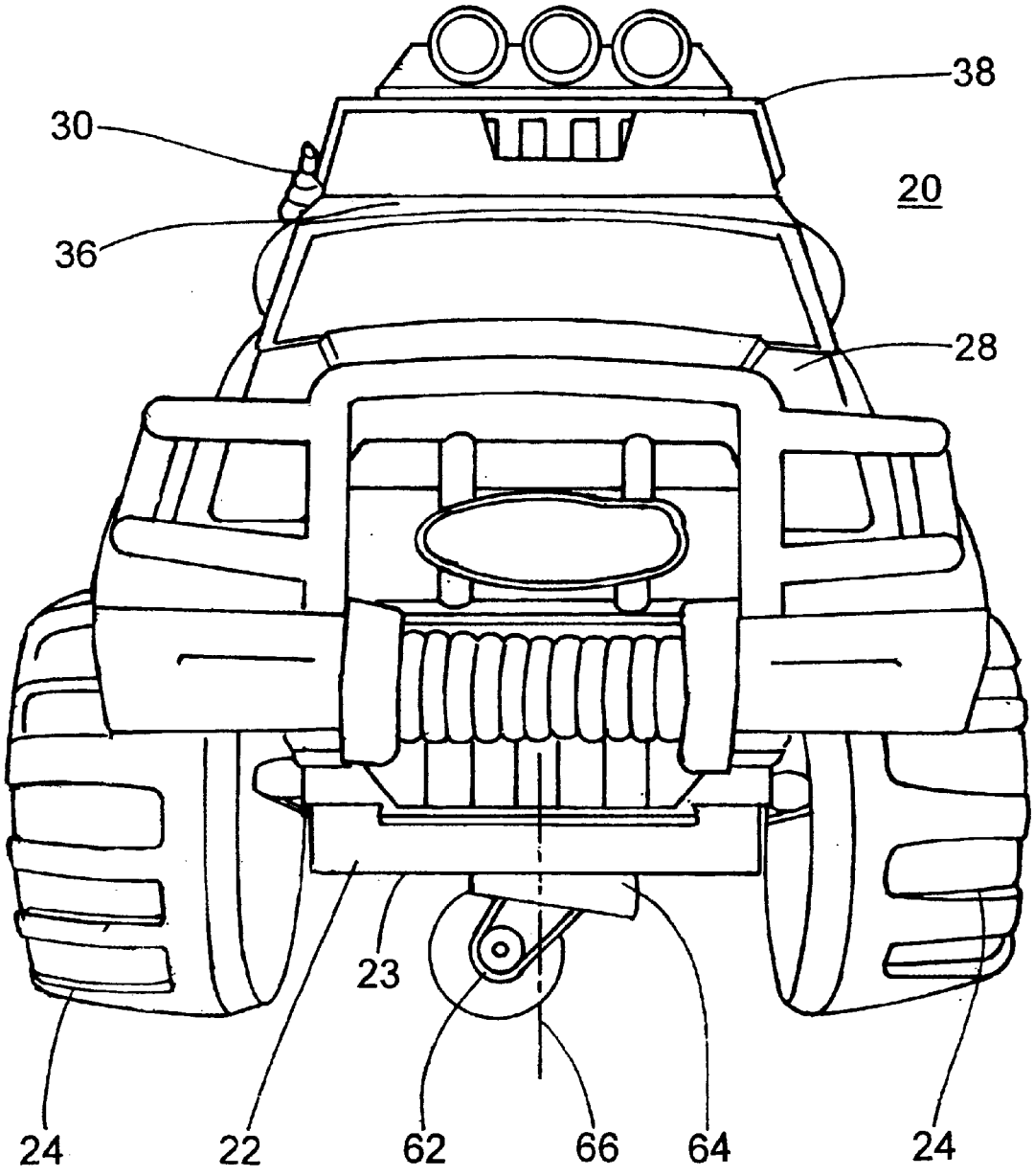
Figure 3:
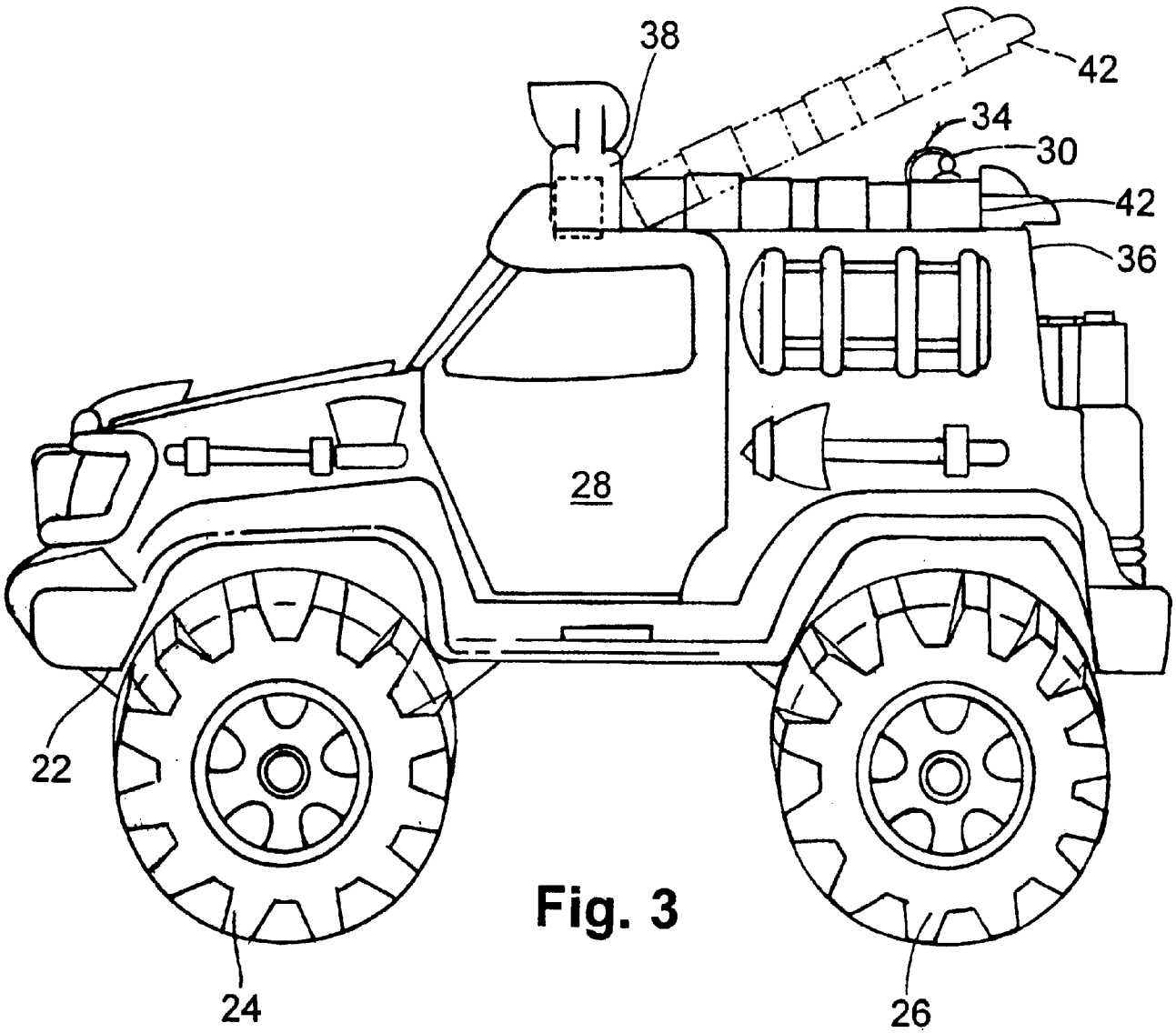
Figure 4:
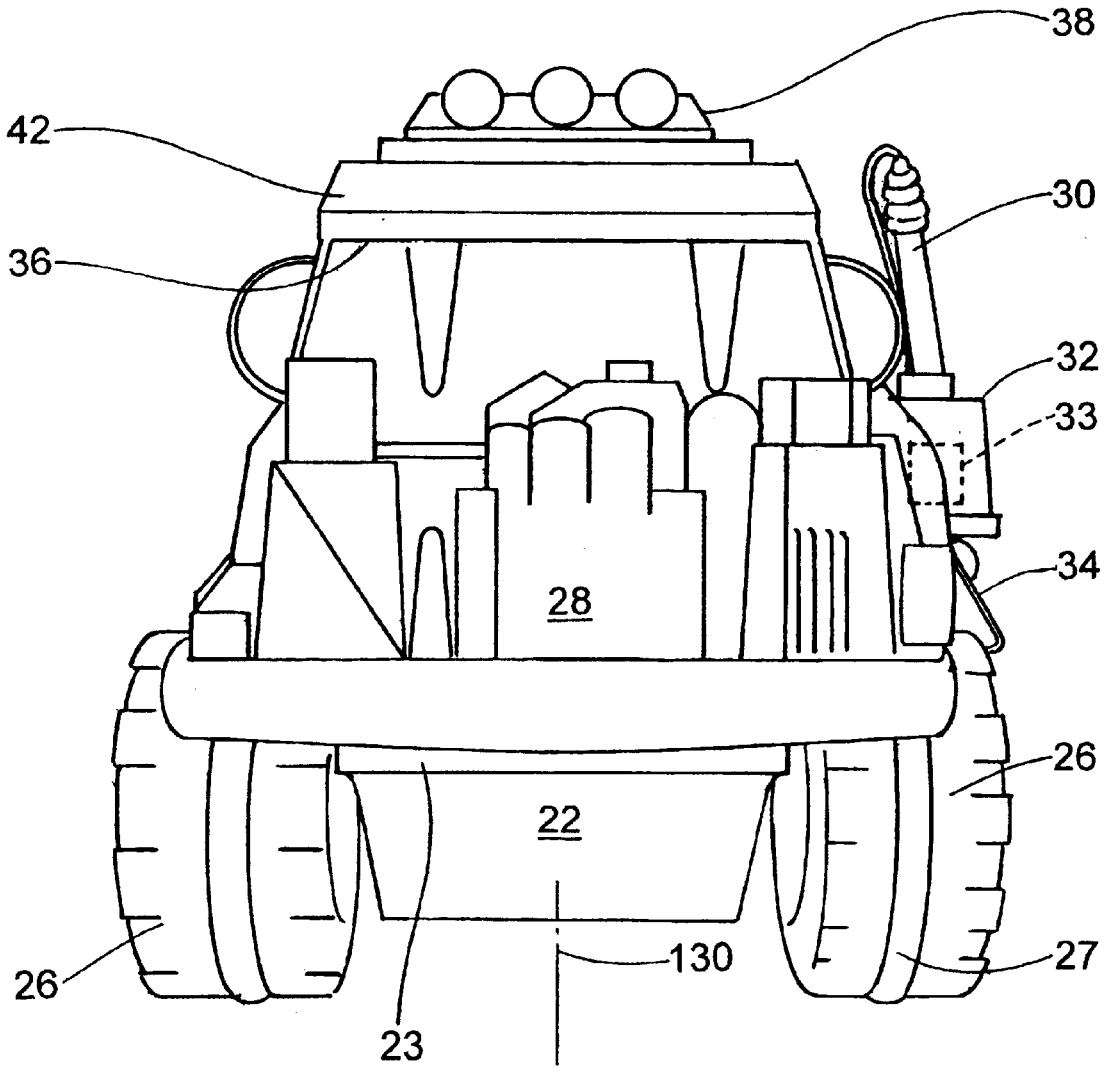
Figure 5:
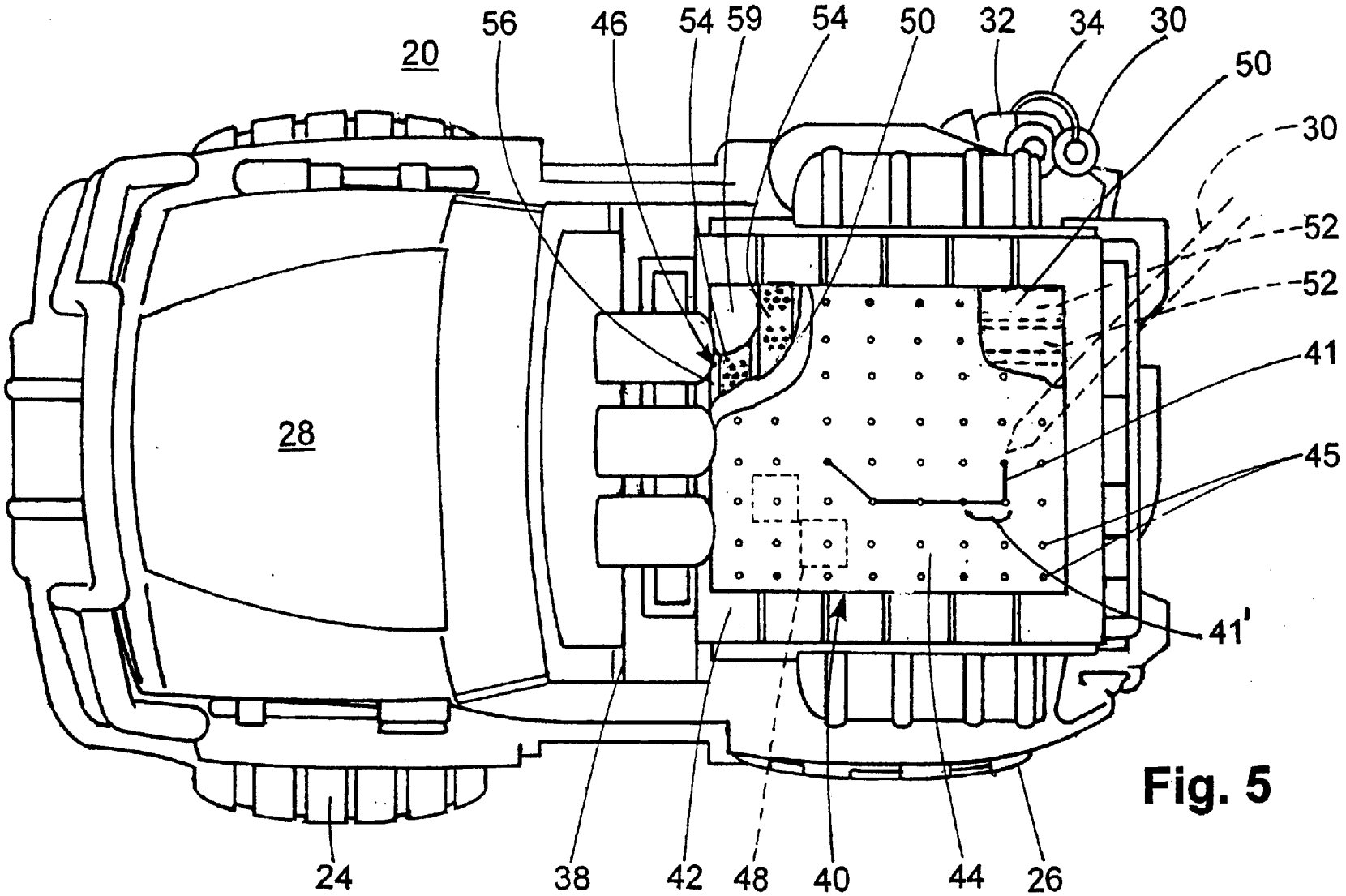
Figure 6:
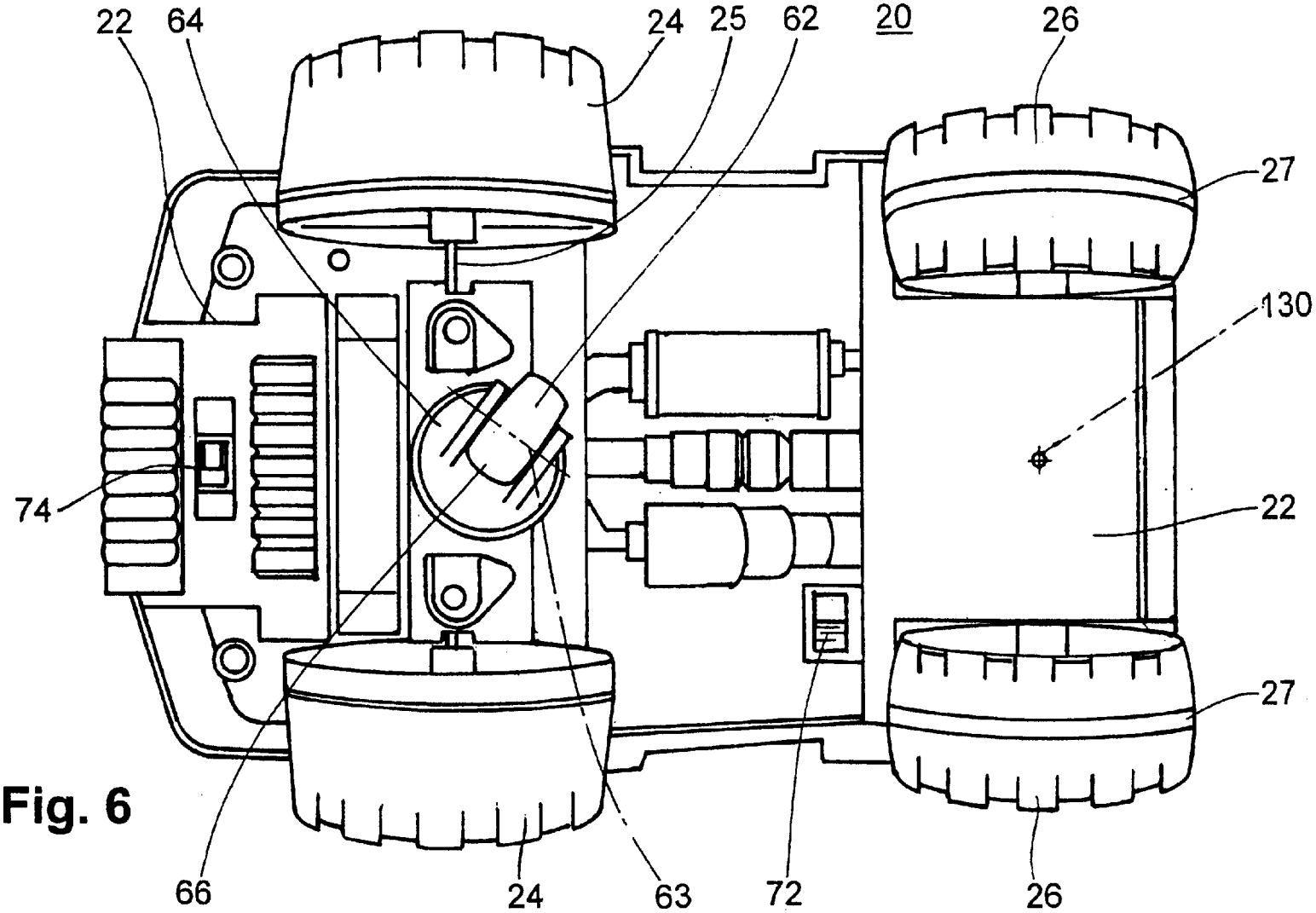
Figure 7:
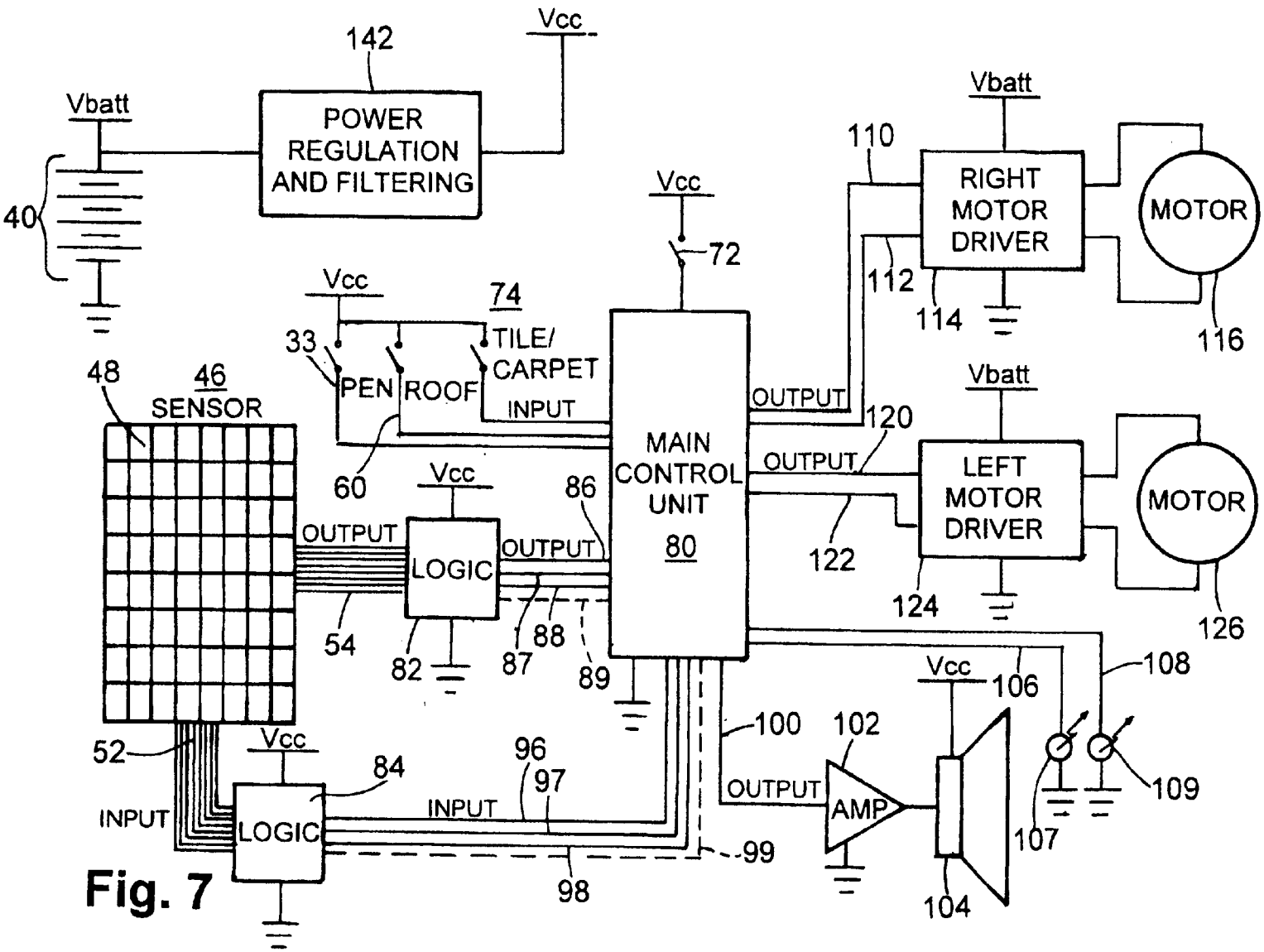
Figure 8:
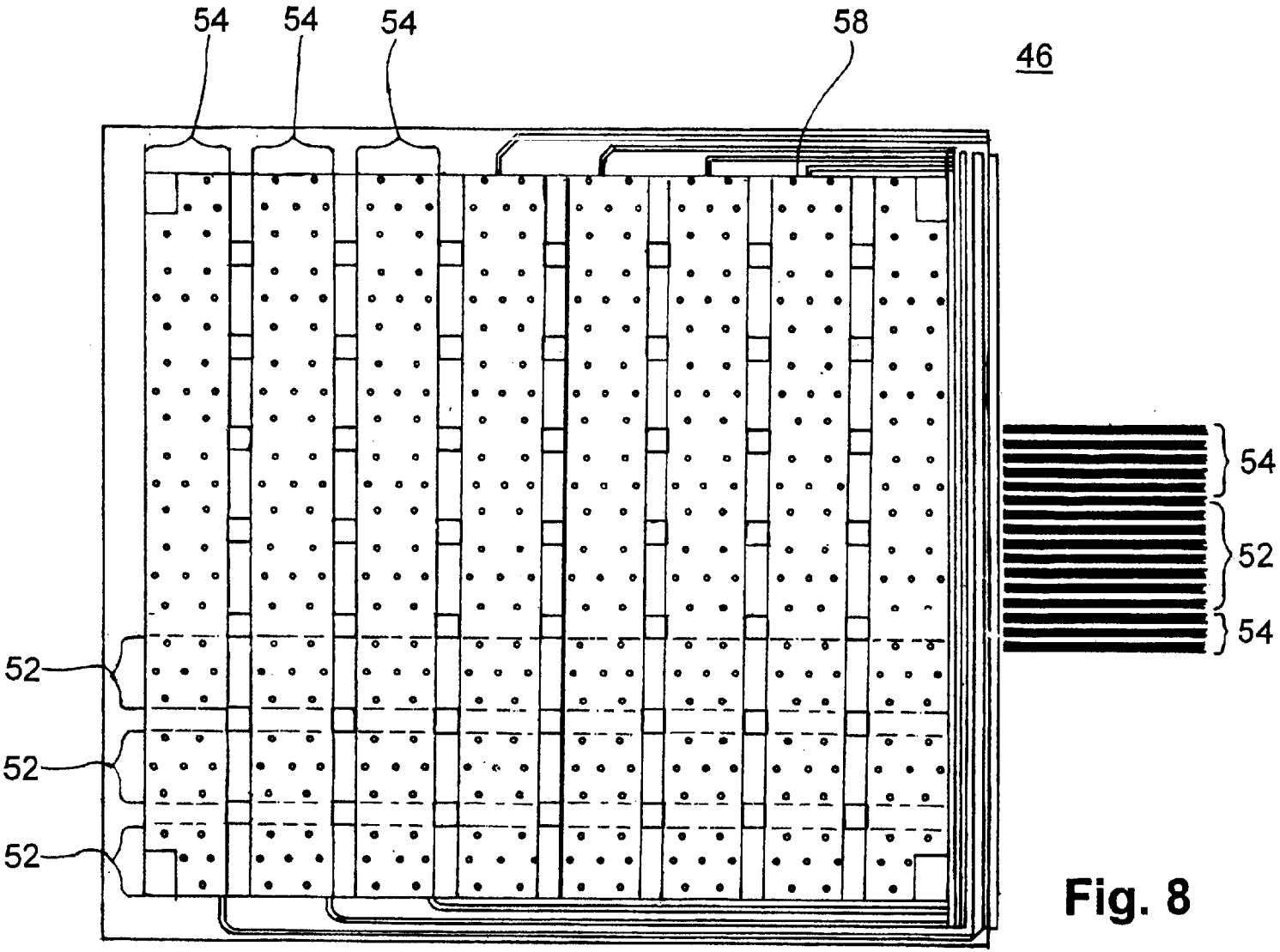
Figure 9:
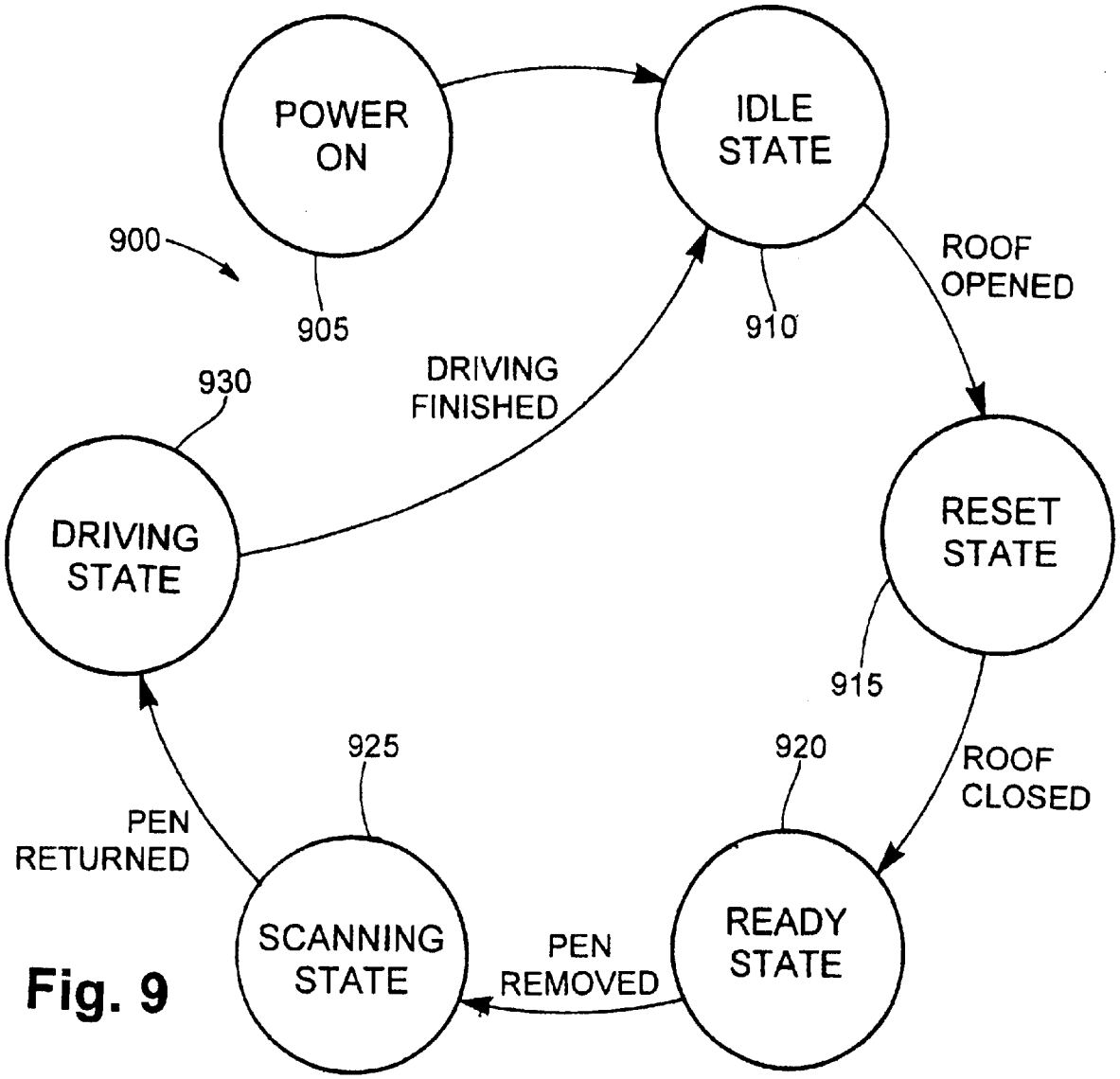
Figure 11:
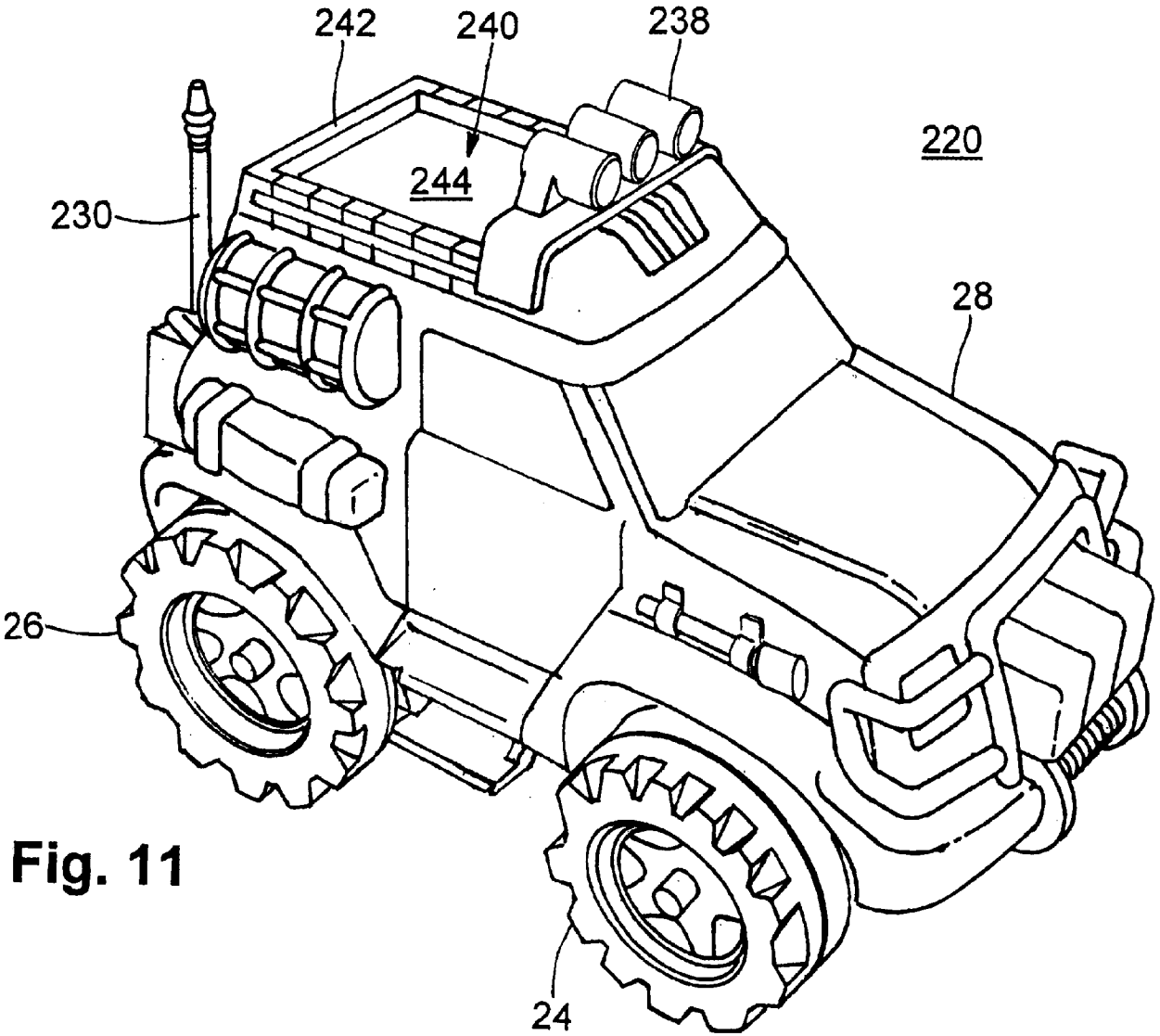
Figure 12:
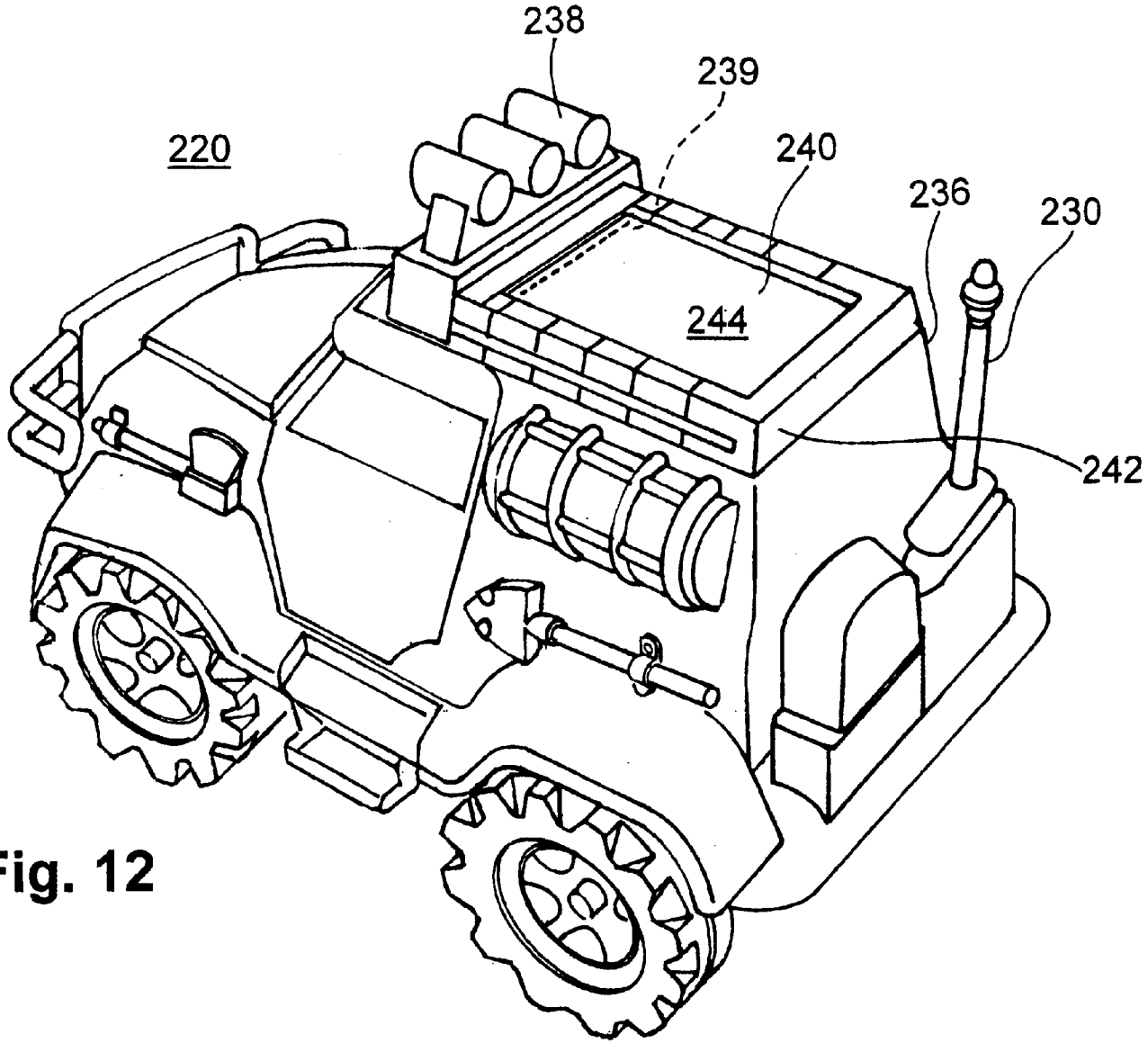

The following detailed description of preferred embodiments of the present invention, will be better understood when read in conjunction with the appended drawings. For the purpose of illustrating the invention, there is shown in the drawings embodiments which are presently preferred. It should be understood, however, that the present invention is not limited to the precise arrangements and instrumentalities shown. In the drawings:

FIG. 1 is a right side elevation view of a manually programmable toy vehicle according to the preferred embodiment of the present invention;

FIG. 2 is a front elevation view of the toy vehicle of FIG. 1;

FIG. 3 is a left side elevation view of the toy vehicle of FIG. 1;

FIG. 4 is a rear elevation view of the toy vehicle of FIG. 1;

FIG. 5 is a top plan view of the toy vehicle of FIG. 1;

FIG. 6 is a bottom plan view of the toy vehicle of FIG. 1;

FIG. 7 is a schematic diagram of electromechanical components of the toy vehicle of FIG. 1;

FIG. 8 is schematic bottom plan diagram of one pressure switch array construction of the toy vehicle of FIG. 1;

FIG. 9 is a state diagram of the operation of the toy vehicle of FIG. 1;

FIGS. 10A, 10B, 10C, 10D, 10E, 10F and 10G collectively constitute a flow chart of the operation of the toy vehicle of FIG. 1;

FIG. 11 is a front prospective view of an alternative of a manually programmable toy vehicle in accordance with the present invention; and FIG. 12 is a rear prospective view of the toy vehicle of FIG. 11.

DETAILED DESCRIPTION OF THE INVENTION

A first embodiment, manually programmable toy vehicle is indicated generally at 20 in FIGS. 1–6. Vehicle 20 includes a motive chassis 22 configured for itinerant movement with the provision of a pair of unpowered front wheels 24 mounted on an axle 25 for free rotation on the motive chassis 22 and preferably a pair of independently powered rear wheels 26, which maneuver (propel and steer) the vehicle 20. One or more elastic O-rings 27 can be provided on each of the rear wheels 26 to increase the friction of the surfaces of the wheels or the wheels can be formed from a conventional plastic or rubber composition having a relatively high coefficient friction to assure that they grip the surface on which the vehicle 20 is operated. An off-road vehicle body 28 is mounted to the motive chassis 22 but it will be appreciated that other vehicle styles can be mimicked in different variations of the present invention.

A stylus 30 is received in a stylus holder 32 formed on the right rear fender of the vehicle body 28. A lanyard 34 may be optionally provided to prevent the stylus 30 from being separated from the vehicle 20. The lanyard 34 functions only to mechanically secure the stylus 30 with the remainder of the vehicle 20. A stylus switch 33 (indicated in block diagram form in phantom in FIGS. 1 and 4) is provided in the stylus holder 32 to generate a two-state signal indicating the presence of the stylus 30 in or its absence from the stylus holder 32. The itinerant movement of the vehicle 20 is initiated in response to the stylus switch 33 detecting presence of the stylus 30 away from the exposed surface of touch screen assembly 40. At least one of a visual indicator and an audio generator is activated by the main control unit/microprocessor 80 in response to the stylus switch 33 detecting the presence of the stylus 30 in stylus holder 32.

Referring to FIG. 5, the top plan view of the vehicle 20, the roof 36 is occupied by a decorative spotlight bar 38 and a mechanical touch screen assembly indicated generally at 40. The mechanical touch screen assembly 40 includes a generally rectangular touch screen frame 42 with an open center, which covers a first flexible, preferably transparent, electrically nonconducting colored plastic sheet 44. The touch screen frame 42 is preferably pivotally mounted at its front end to the roof 36 of motive chassis 22 and is further preferably coupled or otherwise operatively connected with a suitable roof frame switch 60, indicated in phantom in FIG. 1, which indicates whether the touch screen frame 42 is pivoted away from or contacting the roof 36. The upper side of the transparent colored plastic sheet 44 defines the exposed surface of the touch screen assembly 40. The touch screen frame 42 and transparent colored plastic sheet 44 overlay a sensor array 46 of pressure sensor switches 48 which includes a top white second, flexible, electrically non-conducting plastic sheet 50. When positioned down against the roof 36, touch screen frame 42 holds sheet 44 against sheet 50. As the tip of the stylus 30 or any other pointed object is pressed against the transparent colored plastic sheet 44 of the held together sheets 44, 50, the pressure of the stylus 30 moving across the exposed surface of sheet 44 causes a visible mark (e.g., see line pattern 41 in FIG. 5) to appear on the transparent colored plastic sheet 44 where the transparent colored plastic sheet 44 temporarily adheres to the underlying white plastic sheet 50 that corresponds to the manually drawn path. The line pattern 41 is formed by a set of consecutive line segments. The line segments are substantially proportional to the distances traveled by the vehicle 20 when it follows the manually drawn path. Together, the transparent colored plastic sheet 44 and the white plastic sheet 50 form a conventional mechanical "magic slate" portion of the touch screen assembly 40. The sensor array 46 underlies the sheets 44 and 50 and can be implemented in a variety of ways. Transparent colored plastic sheet 44 is cut away in the upper right corner in FIG. 5 to reveal white plastic sheet 50. Further cuts are made in the upper left corner of the transparent colored plastic sheet 44 to reveal other underlying layers of sensor array 46. The sensor array 46 is located in an opening in the roof 36 under the touch screen frame 42.

Referring to FIGS. 5, 7 and 8, the sensor array 46 can be provided by white plastic sheet 50 on which is mounted a plurality (e.g., eight) bar electrodes 52, which are extended at least substantially entirely along the white plastic sheet 50, uniformly spaced apart, within the open center of the touch screen frame 42. These electrodes 52 are on an underside of sheet 50 facing down and are indicated in phantom in FIG. 5. A second member 56 of electrically non-conducting material supports a second plurality (e.g., eight) of bar electrodes 54, which extend perpendicularly to the first electrodes 52 at uniform intervals at least substantially entirely across the member 56 within the open center of the touch screen frame 42. These are indicated in solid in FIG. 5 and are on the upper side of member 56 facing sheet 50. Each overlapping pair of electrodes 52, 54 defines or forms a pressure sensor switch 48 (in phantom in FIG. 5) at their intersection or overlap. The members 50, 56 are spaced apart from one another by suitable, non-conducting means, preferably a grid of small elastomeric elements 58, which also space apart the bar electrodes 52, 54 where the electrodes overlap one another. Thus, the pressure sensor switches 48 include laterally spaced, transversely overlapping pairs of bar electrodes 52, 54. The members 50, 56 can be mylar sheets and the bar electrodes can be made of conductive ink printed on the sheets. Thus, one of members 50, 56 include permanent markings (e.g. printed dots 45) which indicate the locations of the pressure sensor switches. The permanent markings serve as a guide to manually draw the line pattern 41. The electrodes can be strips about ¼ inch wide and spaced apart about 1/16 of an inch. The spacers 58 can be small dots of elastomeric material also printed or screened in a grid on one of the inner sides of the sheets 50, 56 on the surface of the bar electrodes 52 or 54. The dot spacers 58 may be only a few mils or tens of mils in diameter and thickness. The dot spacers are shown as small circles positioned in sets of seven centered between each intersection of electrodes 52, 54 in FIG. 8. The larger solid squares in FIG. 8 represent spaces left between adjoining, overlapping electrodes 52, 54. Each dot spacer 58 directly under or adjoining stylus 30 is easily compressed by the stylus 30 to permit bar electrodes 52, 54 also directly underlying the stylus 30 to come together and form a closed circuit identifying the location of the stylus 30 on the mechanical touch screen assembly 40 in terms of the contacting pair of bar electrodes 52, 54. The mylar sheets 50, 56 and transparent colored sheet 44 can be supported by a rigid surface 59 underlying sheet 56.

Referring to FIG. 7, a main control unit/microprocessor 80 within the vehicle 20 on the motive chassis 22 is operably coupled with motors 116, 126 to control itinerant movement of the motive chassis 22 through the motors 116, 126. The main control unit/microprocessor 80 is further operably coupled with the mechanical touch screen assembly 40 and controls and monitors the state of the pressure sensor switches 48 of the sensor array 46, identifies the sequential contacting of pairs of bar electrodes 52, 54 and collects a set of coordinates based on the sequential closure of the pressure sensor switches 48 of a path of itinerant movement of the vehicle 10 (e.g., see line pattern 41 in FIG. 5) manually drawn on the exposed surface of sheet 44 of the mechanical touch screen assembly 40 with the stylus 30. Thus, the mechanical touch screen assembly 40 includes a plurality of pressure sensor switches 48 of which at least a subset of the pressure sensor switches 48 are closed in a sequence determined by the manually drawn path. The main control unit/microprocessor 80 thus reads each consecutive segment 41' of the manually drawn path 41 and thereafter controls the movement of the motive chassis 22 of the vehicle 20 to follow that path. The main control unit/microprocessor 80 monitors the state of the plurality of pressure sensor switches 48 and identifies the sequential closures of the subset of the pressure sensor switches 48. An array of keys (e.g., dots) 45 is preferably provided on either the transparent colored sheet 44 or the underlying white plastic sheet 50 marking the locations of the center of each of the pressure sensor switches 48 (e.g., crossing bar electrodes 52, 54) to assist the user in operating the device 20. The user should draw a path (e.g., see line pattern 41 in FIG. 5) which connects a plurality of the keys 45 on the mechanical touch screen assembly 40. The consecutive line segments 41' may connect together in a closed loop as well as an open ended path as depicted. The drawn path is erased when the sheets 44, 50 are separated by either pivoting one sheet away from the other (i.e., by pivoting touch screen frame 42 away from the roof 36), of by sliding a horizontal plate element between the sheets. The roof frame switch 60 operably couples the main control unit/microprocessor 80 with the touch screen frame 42 so as to determine a pivotal state of the touch screen frame 42 with respect to the motive chassis 22. At least one of a visual indicator and an audio generator is activated by the main control unit/microprocessor 80 when the pivotal state changes (e.g., the main control unit/microprocessor 80 outputs at least one of a visual and audible signal).

Referring to FIGS. 2 and 6, in addition to the front wheels 24 and the powered rear wheels 26, vehicle 20 is preferably provided with a fifth, castered wheel in the form of a conventional wheel 52 and a castor mounted holder 64, which can pivotally rotate about a laterally centered vertical axis 66. The fifth wheel 62 rotates about a horizontal axis 63 (in FIG. 6) which is laterally displaced from the vertical axis 66 to provide the castering effect. Preferably, the fifth wheel 62 supports the front of the vehicle 20 sufficiently above a level surface so that neither of the front wheels 24 actually comes in contact with the underlying surface. The fifth wheel is provided to enable the vehicle 20 to rotate easily in place in a manner to be described.

Also preferably provided on the vehicle 20 and seen in FIG. 6 are an on/off switch 72 and a tile/carpet switch 74. The latter has at least two states to indicate the type of support surface the vehicle 20 is riding over to adapt the output of the vehicle 20 so that it provides more consistent performances on different surfaces. This will be better appreciated with respect to the electromechanical components of the vehicle 20 which are indicated schematically in FIG. 7.

All operations of the vehicle 20 are controlled by the main control unit/microprocessor 80. The main control unit/microprocessor 80 may be switched on and off through the main switch 72 on the bottom of the vehicle 20. The main control unit/microprocessor 80 is further responsive to signals passed from or through the stylus switch 33, the roof frame switch 60 and the tile/carpet switch 74. The stylus switch 33 is a sensor on the motive chassis 22 that is operably coupled to the main control unit/microprocessor 80. The stylus switch 33 supplies a signal to the main control unit/microprocessor 80 in response to the stylus switch 33 detecting the presence of the stylus 30 away from the exposed surface (i.e., sheet 44) of touch screen frame 42. The main control unit/microprocessor 80 further monitors the sensor array 46 for switch closings through suitable logic circuits 82 and 84, which may simply be eight line multiplexers, or more or less complicated circuits. The main control unit/microprocessor 80 also supplies a control signal on a line 100 which is directed through an amplifier 102 to control power that is variably supplied to an audio (sound) generator 104, which is preferable in the form of a coned speaker but may alternatively be a piezoelectric transducer or other simple, inexpensive, electrically driven, sound generating unit. The main control unit/microprocessor 80 can also supply signals on lines 106 and/or 108 to illuminate LED's 107, 109, respectively or other low load illumination sources (e.g., rice grain bulbs) for simulation of headlights, tail lights, etc.

Motor control signals are also output by the main control unit/microprocessor 80 on lines 110 and 112 to a motor drive circuit 114, which is coupled with and controls the operation of a preferably reversible electric motor 116. Preferably, a second identical pair of output lines 120, 122 carry motor control signals from the main control unit/microprocessor 80 to a second motor driver circuit 124 coupled with and controlling the operation of a second, preferably reversible electric motor 126. Each motor 116, 126 is coupled with a separate one of the two rear wheels 26. The motors 116, 126 can be controlled separately and independently of each other and can be driven simultaneously in the same direction to move the vehicle 20 in a forward or rearward direction, or simultaneously in opposing direction to cause the vehicle 20 to turn in place in either direction about a vertical axis 130 (FIGS. 4 and 6) centered between the rear wheels 26. The fifth wheel 62 is provided in caster mounted holder 64 to enable the front end of the vehicle 20 to easily swing about this centered vertical axis 130. With only one motor 116, 126 operating, the vehicle 20 turns while it translates forward or backward. Finally, a power supply, preferably in the form of a plurality of batteries or rechargeable battery pack and indicated generally at 140, is provided in the vehicle 20. Power regulation and filtering circuitry 142 is provided to draw off some of that power and to convert it into a sufficiently uniformed voltage, Vcc, that can be used to power the main control unit/microprocessor 80 and the logic circuits 82, 84, as well as provide voltage level signals to some of the switches 33, 60, 74 and power the sound generation unit 104. Power directly from the battery, Vbatt, can be applied directly to the motor(s) 116, 126 by the coupled motor driver circuit(s) 114, 124, respectively.

The sequential operations of the main control unit/microprocessor 80 are summarized in the state diagram 900 constituting FIG. 9. Initially the main control unit/microprocessor 80 is turned on through on/off switch 72. The main control unit initializes itself and its operating program including sensing the state of tile/carpet switch 74 and enters the IDLE state 910 in which it monitors the state of the roof frame switch 60. When the roof frame switch 60 indicates that the touch screen frame 42 has been lifted from the roof 36, the main control unit/microprocessor 80 enters a RESET state 915 in which it monitors the roof frame switch 60 for a change of state which indicates that the touch screen frame 42 has been returned to the roof 36 and that the mechanical touch screen assembly 40 has been erased. The main control unit/microprocessor 80 may generate a special effect such as a horn beep and/or a flashing light (visual indicator), if provided, indicating that the vehicle 20 is awaiting new input through the sensor array 46. The main control unit/microprocessor 80 then enters a READY state 920 in which it monitors the state of the stylus switch 33. If the stylus switch 33 is in a state which indicates (senses) that the stylus 30 has been removed from the stylus holder 32, the main control unit/microprocessor 80 enters a SCANNING state 925 in which it essentially powers and monitors the state of the pressure sensor switches 48 in the sensor array 46 for input. More particularly, control signals on lines 86–88 control the operation of the logic circuit 82 to connect a suitable voltage source, either Vcc applied to the logic circuit 52 or a different signal supplied by the main control unit/microprocessor 80 on line 89, to each of the bar electrodes 54 of the sensor array 46. Logic unit 84 can be designed to automatically signal the main control unit/microprocessor 80 on lines 96–98 which, if any, of the eight electrodes 52 is in contact with one of the electrodes 54 or may just poll each of the lines 52 and pass their signal back on line 99 for processing by the main control unit/microprocessor 80. In this way, the main control unit/microprocessor 80 can sense each closure of the various pressure sensor switches 48 in temporal order. The ordered switch closings correspond to an itinerant path of movement manually drawn by the user on the mechanical touch screen assembly 40. When the vehicle 20 completes the controlled movement of the motive chassis 22 to follow the manually drawn path, and a predetermined period of time elapses without another path being manually drawn on the exposed surface of the touch screen assembly 40, an audible sound is outputted from an audio generator (i.e., speaker 104) and/or the main control unit/microprocessor 80 deactivates vehicle 20.

The main control unit/microprocessor 80 remains in the SCANNING state 925 until it senses a change in state of the stylus switch 33. It then enters a DRIVING state 930 in which the main control unit/microprocessor 80 interprets the switch closure data it has stored in its memory from the sensor array 46 of the mechanical touch screen assembly 40 and generates control signals supplied on the lines 110, 112, 120, 122 to selectively power each of the two motors 116, 126 to cause the vehicle 20 to follow the itinerant path manually entered into the sensor array 46. Depending upon the state of the floor switch 74, the motors 116, 126 may be provided with different power for different periods of time to accomplish the same movement representing the distance and direction between any two pressure sensor switches 48 of the sensor array 46. Signals can also be sent on lines 100, 106 and/or 108 to operate appropriate sound and/or light effects. After traversing an equivalent of the path drawn on the sensor array 46, the main control unit/microprocessor 80 can reenter the IDLE state 910 waiting for new input. The main control unit/microprocessor 80 can be configured to repeatedly follow any closed loop path drawn on the sensor array 46 and to continue traversing the same path until interrupted by a change in state of one of the switches 72, 33, 60. The sound and light generation devices 104, 107, 109 can also be used to instruct the user or denote the transition of the main control unit/microprocessor 80 between states.

An exemplary scenario for special effects is a sound (e.g. "BEEP-BEEP") and/ or a light flash after the vehicle 20 is turned on. When the stylus 30 is removed from the stylus holder 32, the vehicle 20 can produce the statement, "YOU DRAW, I DRIVE." When the stylus 30 is replaced in stylus holder 32, the lights of vehicle 20 can go on or flash and a motor running sound generated. As the vehicle 20 drives the drawn path, lights on one side can be activated for turning. The rear lights can be activated when the car stops. The horn sound can be duplicated when the vehicle 20 has finished driving the pattern. Suggested speed may be about 1 foot per second and the vehicle 20 may be programmed to drive on a scale of 1 foot per inch of path on the mechanical touch screen assembly 40.

FIGS. 10A–10G represent a more detailed flow chart of the operation of the main control unit/microprocessor 80 in the various states.

Figure 10A:
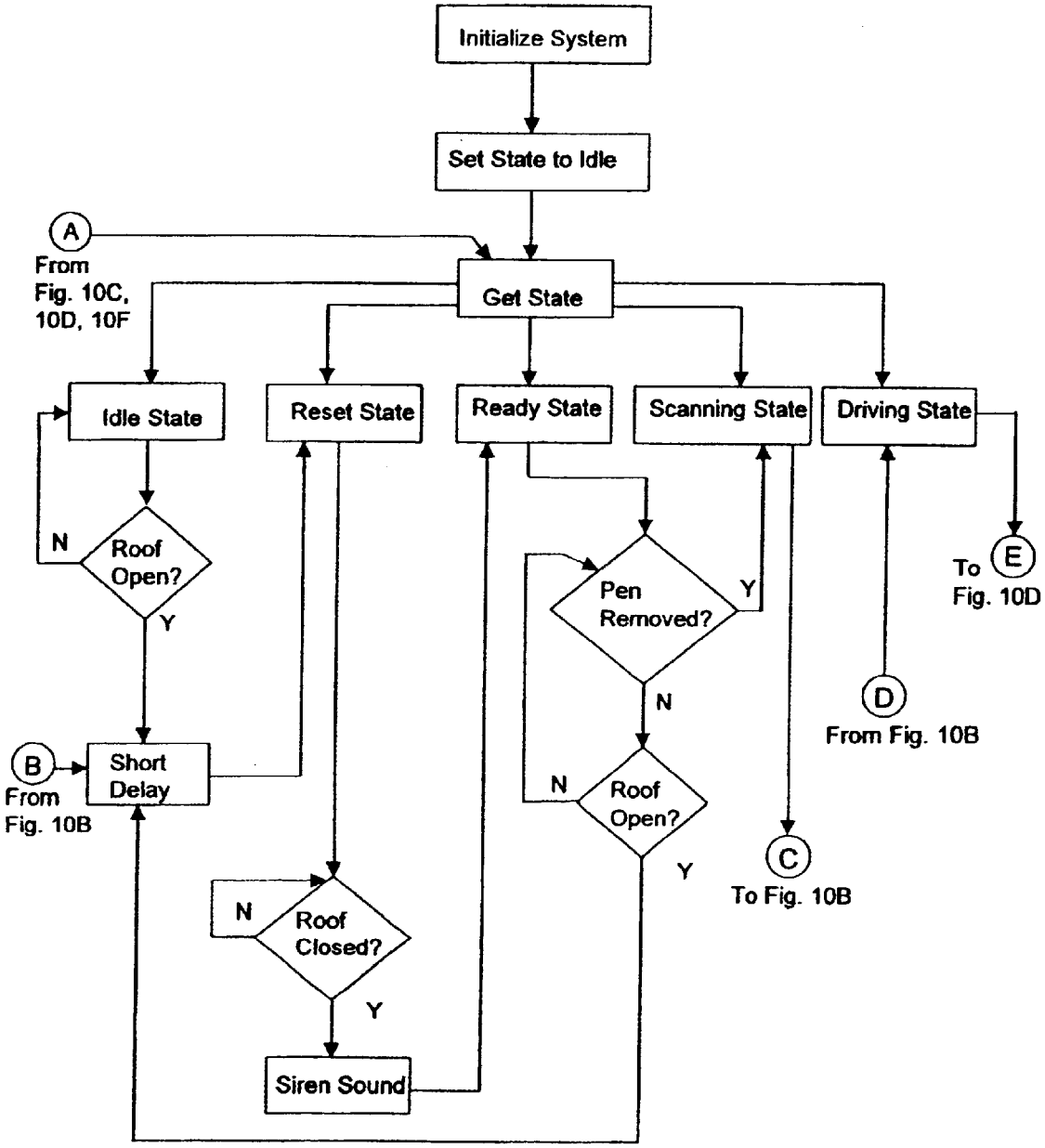

As shown in FIG. 10A, the toy vehicle is activated when the roof of the vehicle is opened and then closed. The toy vehicle will then make a siren sound indicating that it is ready to be programmed by the user. The itinerant maneuvers of the toy vehicle are programmed by drawing on the mechanical touch screen assembly mounted on the roof of the toy vehicle with a pen (e.g., stylus). The pen connects points on a grid on the touch screen assembly which are stored in the main control unit/microprocessor 80. The toy vehicle travels from point 1 to point 2, then point 2 to point 3, and so on, in accordance with the stored points.

As shown in FIGS. 9 and 10A, firmware in the toy vehicle operates as a state machine which has five (5) discreet states which include the idle state (presently doing nothing), reset state, ready state (ready for input), scanning state (reading key inputs) and the driving state. The state of the vehicle is stored as a variable. The firmware continuously looks at what state the firmware is in and then branches to the subroutine specific to that state. No matter what state the toy vehicle is in, the firmware will first check to see if predetermined conditions have been met to change the state. If the conditions have been met, the stored variable is set equal to the new state, a function is performed (such as outputting of a sound), and then the firmware branches to the new state. If the state does not change, the firmware performs actions specific to its current state.

FIG. 10A shows firmware subroutines for the five different firmware states. When the firmware is in the idle state, the state of the firmware transitions to the reset state a short period of time (delay) after the roof of the toy vehicle is opened. When the firmware is in the reset state, closing the roof causes a siren sound to be outputted from the toy vehicle and the state of the firmware transitions to the ready state. When the firmware is in the ready state, removing the "pen" (i.e., stylus 30) from its holder causes the firmware to transition to the scanning state. If in the ready state the pen is not removed from its holder and the roof of the toy vehicle is again opened, the firmware transitions from the ready state to the reset state after a short delay.

Figure 10B:
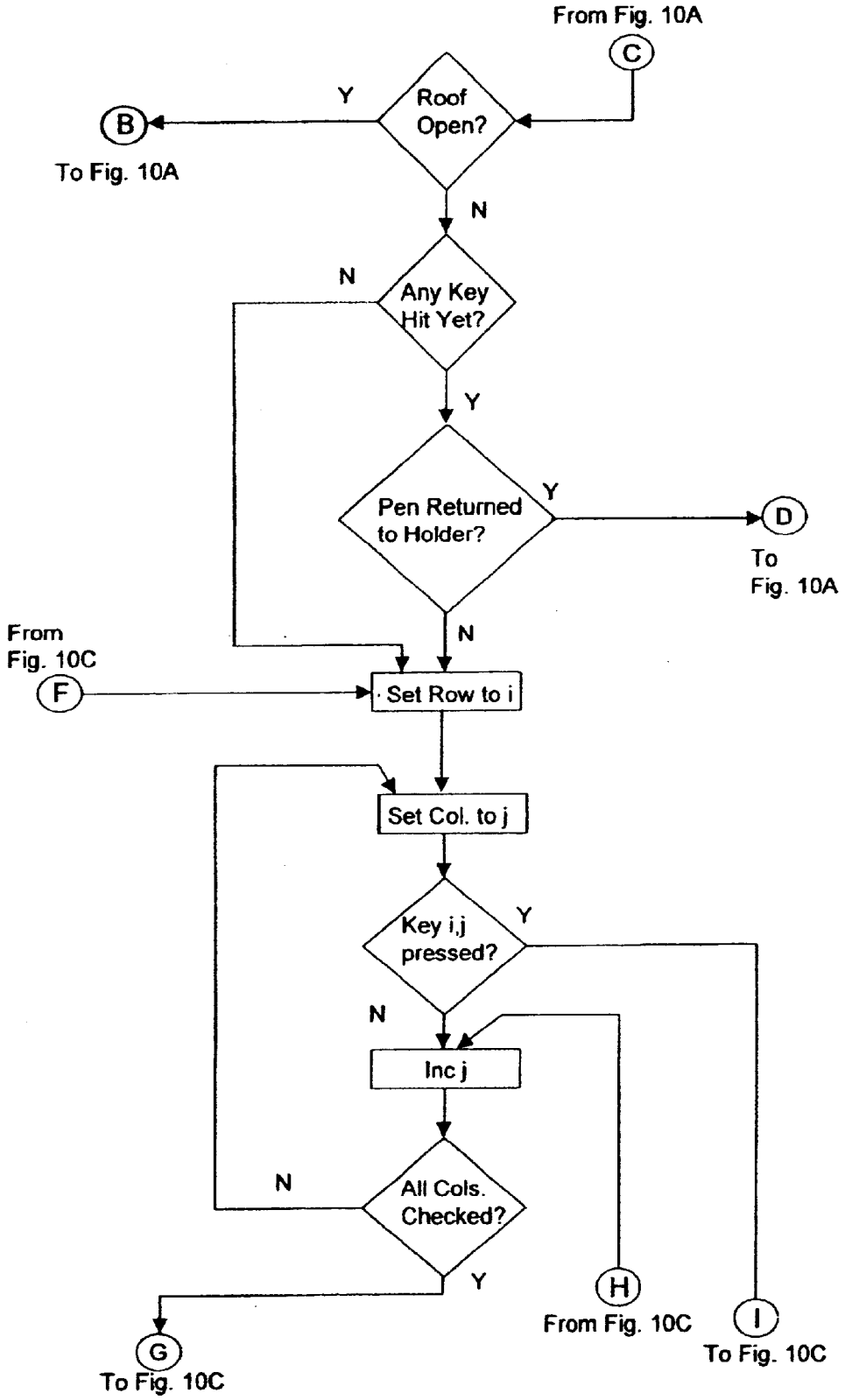

Referring now to FIGS. 10A and 10B, when the firmware is in the scanning state, and the roof of the toy vehicle is open, the firmware transitions to the reset state after a short delay. If the firmware is in the scanning state and the roof is closed, the firmware scans the "keys" (i.e., pressure sensor switches 48) on the mechanical touch screen assembly 40to determine whether any have been selected using the pen. The term "Inc" in FIG. 10B and other flow chart figures stands for increment.

Figure 10C:
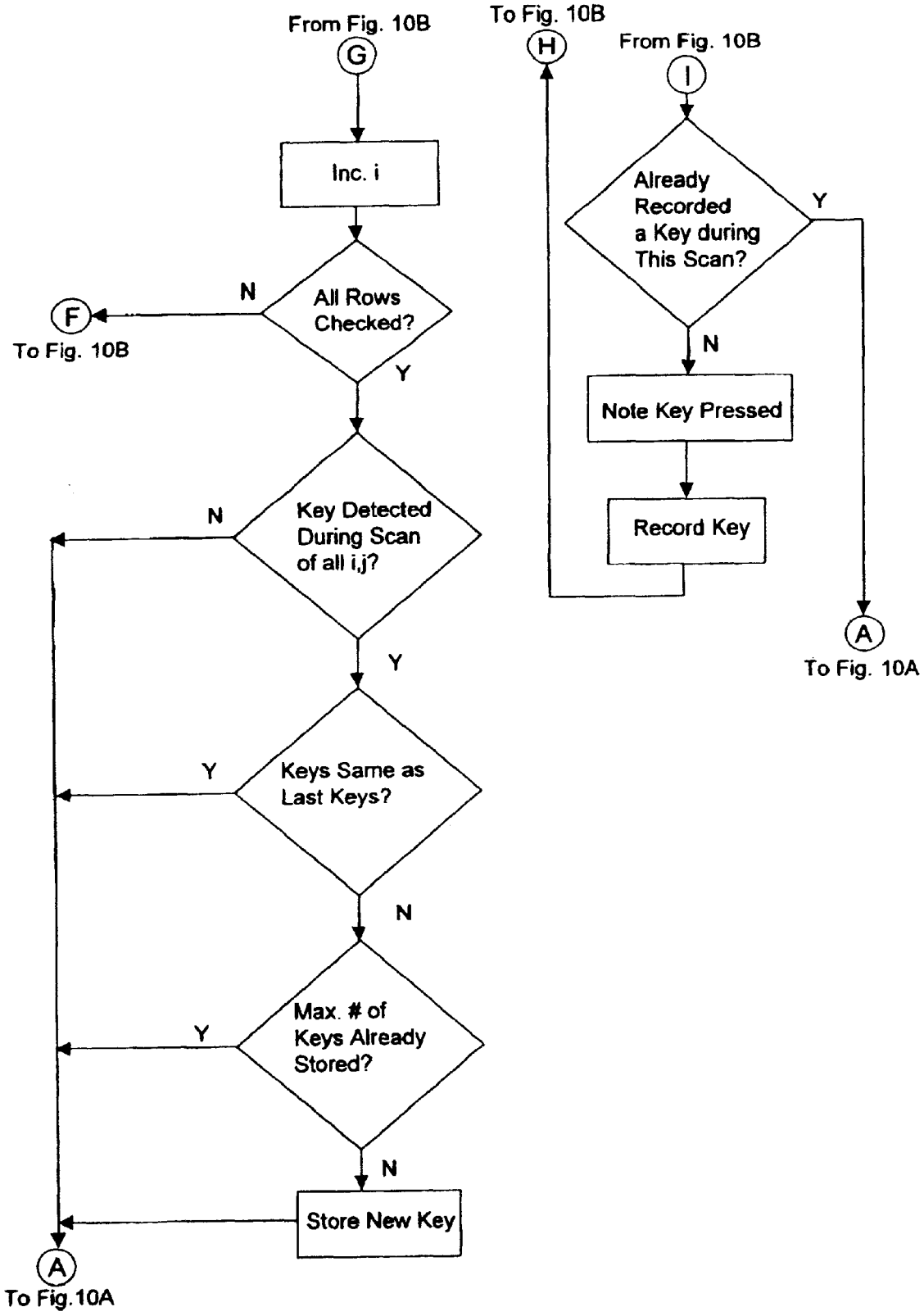

FIGS. 10B and 10C illustrate the operation of a scanning state routine used to read inputs provided by a user drawing on the mechanical touch screen assembly 40 using the pen (i.e., stylus 30). When the firmware is in the scanning state, if a key (i.e., pressure sensor switch 48) on the mechanical touch screen assembly 40 was not selected, or if the pen was not returned to its holder after a key was selected, then logic associated with the columns and rows of keys on the mechanical touch screen assembly 40 are set to a pattern of logic highs and low, as determined by the main control unit/microprocessor 80. As different keys are selected by a user pressing on them while drawing a path on the touch screen assembly with the pen, the logic is used to interpret the drawn path and the identities of the keys associated with the path are stored. The identity of a key is not stored if it was already recorded (the last key recorded), or if there is no more room in memory, where a maximum number of key identities have already been stored.

Figure 10D:
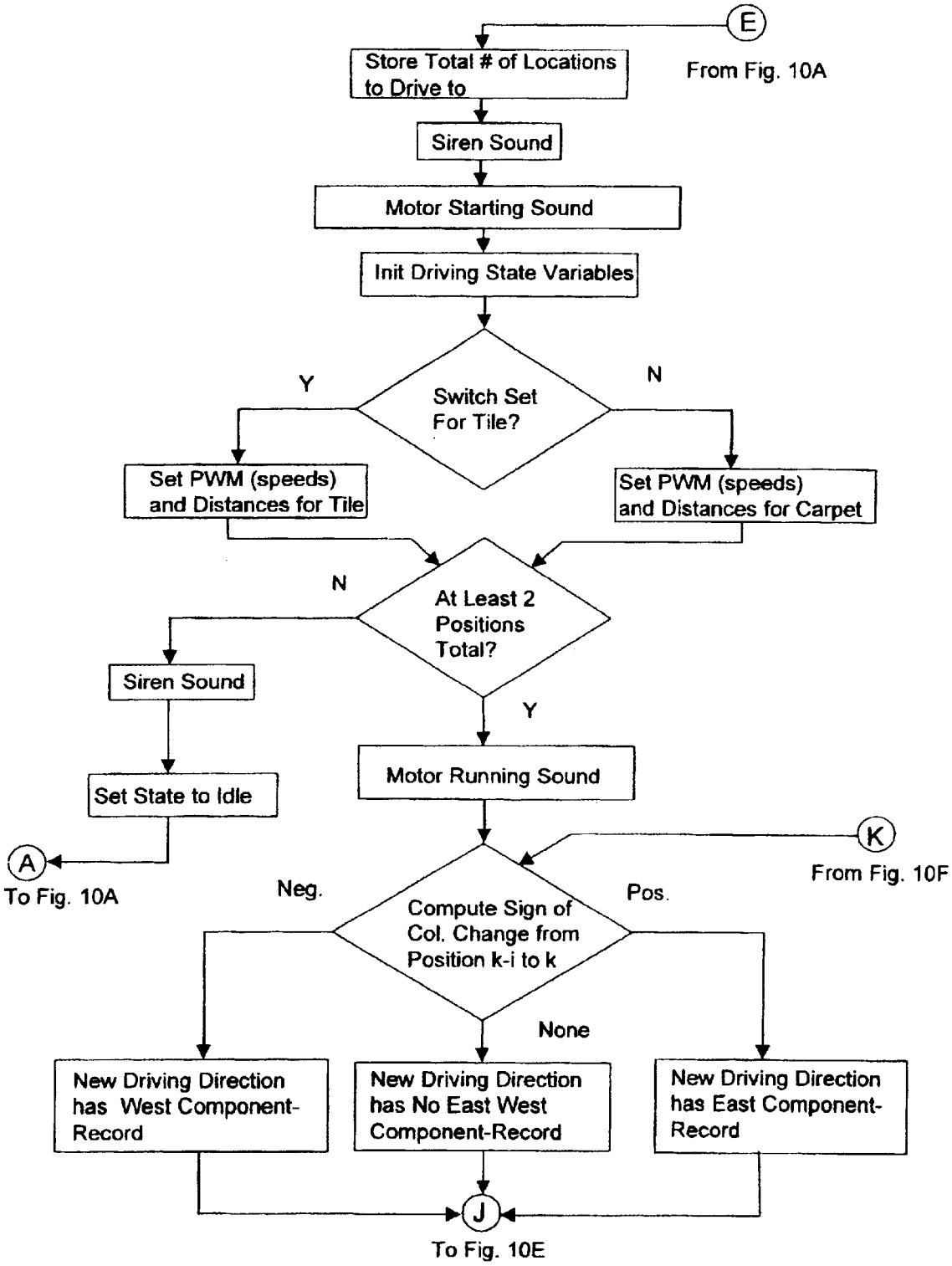
Figure 10E:
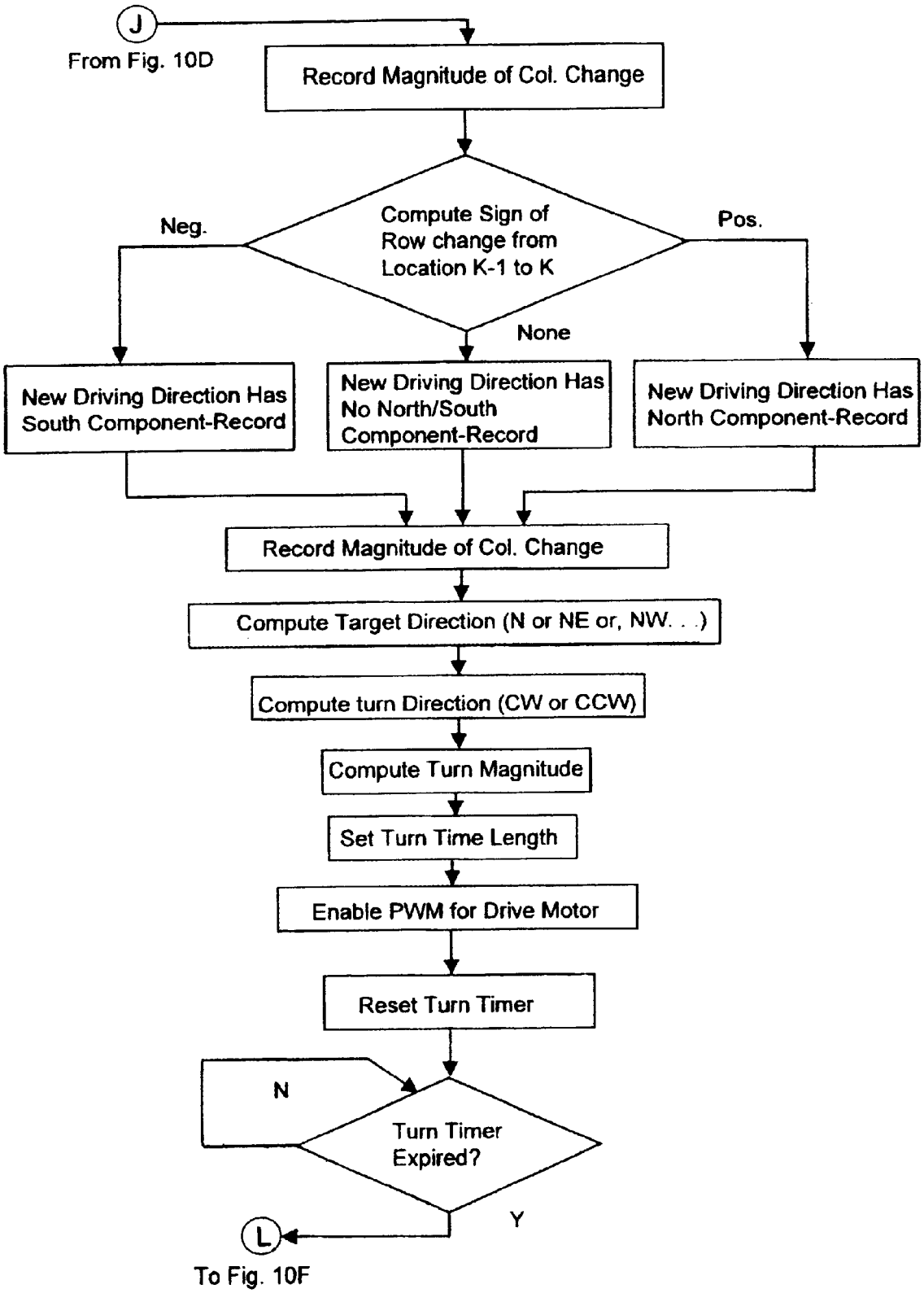
Figure 10F:
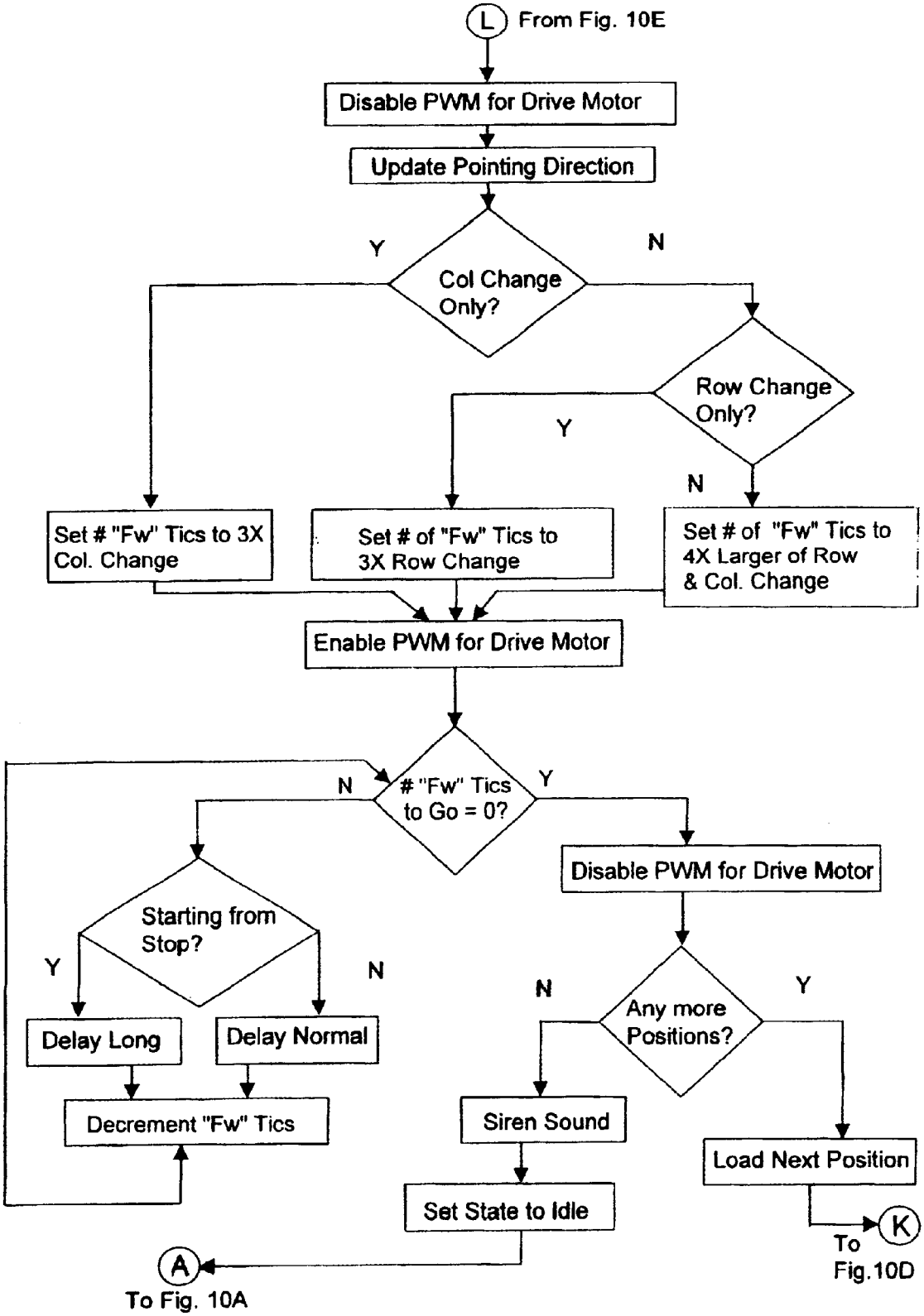

FIGS. 10D, 10E and 10F illustrate the operation of a driving state routine. North is the forward facing direction of the vehicle. The firmware transitions to the driving state after the pen is returned to its holder. The firmware stores the total number of drive locations (point 1 to point 2), makes sounds, checks to see if it is driving on tile or carpet, and sets PWM motor rates as is appropriate. If less than two keys (corresponding to 2 positions) is selected (i.e., if only one pressure sensor switch 48 has been depressed), the toy vehicle does not move and instead outputs a siren sound. The firmware then transitions to the idle state. Otherwise, the toy vehicle outputs a motor running sound and the direction of travel is computed (including some information about magnitude). The motor(s) is then activated for a set length of time, depending on the angle of turn direction. The magnitude of the travel is then computed, and the motors are turned on to move the toy vehicle forward for an amount of time correlating to the magnitude of travel. This process repeats until all points, which have been programmed by a user pressing on the keys (i.e., pressure sensor switches 48) of the mechanical touch screen assembly 40 while drawing a path, have been driven by the toy vehicle 10.

Figure 10G:
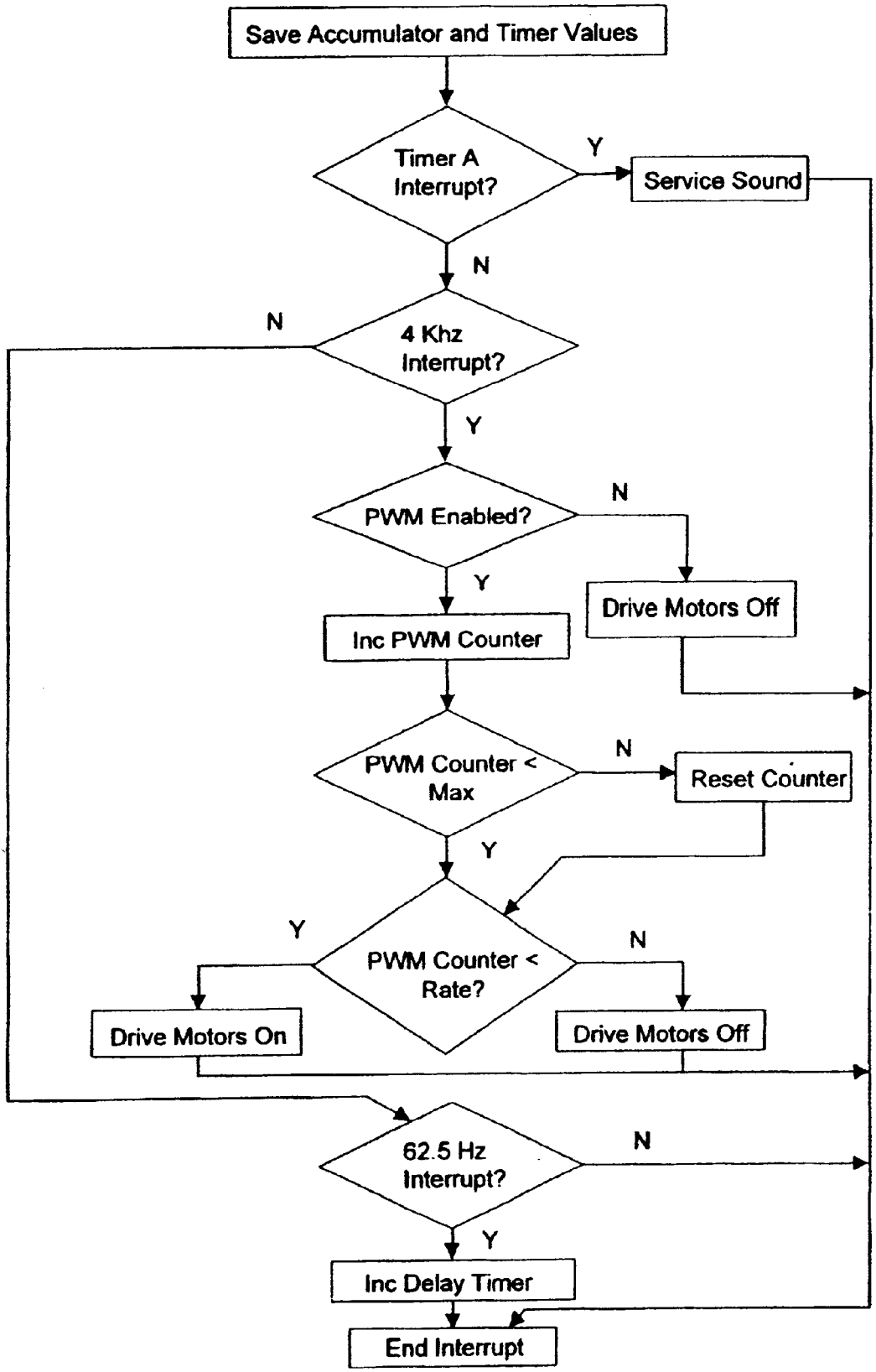

FIG. 10G illustrates an interrupt service routine. There are 3 interrupt sources: (1) Timer A (set to operate at 6 KHz), (2) a 4 KHz interrupt source, and (3) a 62.5 Hz interrupt source. The firmware looks at a variable set by the main control unit/microprocessor 80 to determine which of these events caused an interrupt and responds appropriately. If it was a "Timer A" interrupt, then sound is serviced. PWM is serviced at a 4 KHz interrupt. The 62.5 Hz interrupt is used to increment a timer which is used for timing events, such as how long it takes to turn the wheels of the toy vehicle 90 degrees.

FIGS. 11 and 12 depict an alternate vehicle embodiment indicated generally at 220 which includes motive chassis 22 with front wheels 24 and rear wheels 26. Reversible motors 116, 126 independently drive rear wheels 26 for itinerant movement. The underside of the vehicle 220 is the same as vehicle 20. Vehicle 220 is slightly different from vehicle 20 in that the operation of mechanical touch screen assembly 240 is somewhat different from mechanical touch screen assembly 40. The frame 242 holding the flexible transparent colored plastic sheet 44 is secured to the roof 236 and the spotlight bar 238 is made to slide backward and forward along the frame 242. The spotlight bar 238 has a closed rectangular loop shape with a horizontal plate element or portion 239 extending between the sides of the frame 242 and between the flexible transparent colored plastic sheet 244 and the white plastic sheet 50 of the underlying sensor array 46 of pressure sensor switches 48. In this embodiment, marks formed on the sheet 244 by contact between the sheets 244, 50 are erased when the sheets are separated by passage of (sliding) the horizontal plate member 239 between them. The frame switch is also varied in vehicle 220. The frame switch can be a self contained switch whose state is changed by contact with the plate member 239 or other portion of the spotlight bar 238 or a light switch similarly affected by the member 239 or spotlight bar 238 or may be formed by an electrode on some portion of the spotlight bar 238 which comes into contact with a stationary electrode on the roof to indicate the movement of the spotlight bar 238. In this embodiment, stylus 230 is disguised as a vehicle antenna. No lanyard is provided.

While one type of sensor array has been disclosed, it will be appreciated that a variety of different sensor arrays including other types of mechanical and other electrosensing and optical sensing sensor arrays can be provided.

It will further be appreciated that different motor arrangements may be provided including the use of a single motor and transmission to drive the vehicle in a forward direction or forward and rearward directions, if reversible, or a steering motor or similar servo to rotate a pair of the wheels to steer the vehicle as it moves.

It will further be appreciated that in addition to sound generation and/or light activation, the vehicle can be configured with moveable components the activation of which can be controlled by the main control unit/microprocessor 80.

U.S. Provisional Patent Application Ser. Nos. 60/290,382 filed May 11, 2001, and 60/267,683 filed Feb. 9, 2001, are incorporated by reference herein in their entireties.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention. Applicants claim each and every novel, inventive aspect of the disclosed programmable toy vehicles and their operation.

What is claimed is:

1. A programmable toy vehicle configured for itinerant maneuvers, the vehicle comprising:

a motive chassis with at least one maneuver motor;

a microprocessor on the motive chassis operably coupled with at least the one motor and configured to control itinerant maneuvers of the vehicle at least in part through the motor; and a mechanical touch screen assembly on the motive chassis operably coupled with the microprocessor and configured to input to the microprocessor a path of itinerant movement of the vehicle manually drawn on an exposed surface of the touch screen assembly, wherein the microprocessor reads the manually drawn path and controls movement of the motive chassis to follow the manually drawn path.

2. The programmable toy vehicle of claim 1 wherein the touch screen assembly comprises:

a first flexible sheet having a major surface defining the exposed surface;

a second flexible sheet underlying the first sheet; and a frame with an open center which holds the first and second flexible sheets together on the motive chassis, wherein pressure applied by a stylus moving across the exposed surface causes the first sheet to temporarily adhere to the second sheet, the adherence causing appearance of a line pattern that corresponds to the manually drawn path.

3. The programmable toy vehicle of claim 2 wherein the touch screen assembly further comprises a plurality of pressure switches, at least a subset of the switches being closed in a sequence determined by the path manually drawn on the exposed surface.

4. The programmable toy vehicle of claim 3 wherein the microprocessor at least monitors the plurality of pressure switches, identifies the sequential closures of the subset of switches, and processes a set of coordinates associated with the line pattern from the sequential closures.

5. The programmable toy vehicle of claim 3 wherein the pressure switches comprise laterally spaced, transversely overlapping pairs of bar electrodes.

6. The programmable toy vehicle of claim 3 wherein one of the first and second sheets include permanent markings which indicate locations of the pressure switches, the markings serving as a guide to manually draw the line pattern.

7. The programmable toy vehicle of claim 2 wherein the line pattern is erased when the first and second sheets are separated.

8. The programmable toy vehicle of claim 7 wherein the first and second sheets are separated by sliding a horizontal plate element between the first and second sheets.

9. The programmable toy vehicle of claim 7 wherein first and second sheets are separated by pivoting the first sheet away from the second sheet.

10. The programmable toy vehicle of claim 2 wherein the line pattern is formed by a set of consecutive line segments, and the line segments are substantially proportional to distances traveled by the vehicle when it follows the manually drawn path.

11. The programmable toy vehicle of claim 1 wherein the touch screen assembly comprises a rectangular frame which is pivotally mounted to the motive chassis.

12. The programmable toy vehicle of claim 11 further comprising a switch operably coupling the microprocessor with the frame so as to determine a pivotal state of the frame with respect to the motive chassis.

13. The programmable toy vehicle of claim 12 further comprising at least one visual indicator and an audio generator, wherein at least one of the visual indicator and audio generator is activated by the microprocessor when the pivotal state changes.

14. The programmable toy vehicle of claim 1 further comprising:

a sensor on the motive chassis operably coupled with the microprocessor, the sensor supplying a signal to the microprocessor in response to the sensor detecting presence of a stylus away from the exposed surface.

15. The programmable toy vehicle of claim 14 wherein the itinerant movement is initiated in response to the sensor detecting presence of the stylus away from the exposed surface.

16. The programmable toy vehicle of claim 14 further comprising at least one visual indicator and an audio generator, wherein at least one of the visual indicator and audio generator is activated by the microprocessor in response to the sensor detecting the presence of the stylus.

17. The programmable toy vehicle of claim 1 further comprising an audio generator, wherein an audible sound is outputted from the audio generator when the vehicle completes the controlled movement and a predetermined period of time elapses without another path being manually drawn.

18. A method of programming a toy vehicle including a motive chassis with at least one maneuver motor, a microprocessor on the motive chassis operably coupled with the motor and configured to control itinerant maneuvers of the vehicle at least in part through the motor, and a mechanical touch screen assembly on the motive chassis operably coupled with the microprocessor, the method comprising:

manually applying pressure to an exposed surface of the touch screen assembly while moving along the exposed surface so as to manually draw on the exposed surface a path of itinerant movement of the vehicle; and activating the microprocessor to read the manually drawn path and control movement of the motive chassis to follow the manually drawn path.

19. The method of claim 18 wherein the toy vehicle further includes a sensor on the motive chassis operably coupled with the microprocessor, and wherein the activating step further comprises supplying a signal to the microprocessor in response to the sensor detecting presence of a stylus away from the exposed surface.

20. The method of claim 19 further comprising the step of:

the microprocessor outputting an audible signal in response to the sensor no longer detecting presence of the stylus.

21. The method of claim 19 further comprising the step of:

the microprocessor outputting at least one of a visual and audible signal in response to the sensor detecting the presence of the stylus.

22. The method of claim 18 further comprising the steps of:

erasing the manually drawn path; and activating the microprocessor to output at least one of a visual and audible signal.

23. The programmable toy vehicle of claim 18 wherein a line pattern corresponding to the manually drawn path is formed by a set of consecutive line segments, and the line segments are substantially proportional to distances traveled by the vehicle when it follows the manually drawn path.

24. The method of claim 18 further comprising the step of:

the microprocessor outputting an audible signal in response to the vehicle completing the controlled movement.

25. The method of claim 18 further comprising the step of:

the microprocessor deactivating the vehicle after the vehicle completes the controlled movement and a predetermined period of time elapses without another path being manually drawn on the exposed surface of the touch screen assembly.

* * * * *